US005131856A

United States Patent [19]

Auclair

[11] Patent Number: 5,131,856

[45] Date of Patent: Jul. 21, 1992

[54] UNIVERSAL GROUND CLAMP

[75] Inventor: John W. Auclair, Canaan, Conn.

[73] Assignee: Electric Motion Company, Incorporated, Winsted, Conn.

[21] Appl. No.: 792,909

[22] Filed: Nov. 15, 1991

[51] Int. Cl.[5] ..... H01R 4/66

[52] U.S. Cl. ..... 439/100; 439/799; 24/280

[58] Field of Search ..... 439/100, 799, 800; 174/78; 24/279, 280, 281, 20 LS

[56] References Cited

U.S. PATENT DOCUMENTS 2,423,627 7/1947 Tinnerman ..... 439/100
4,623,204 11/1986 Auclair ..... 439/100
4,626,051 12/1986 Franks, Jr. ..... 439/100
4,664,469 5/1987 Sachs ..... 439/100
4,784,621 11/1988 Auclair ..... 439/793

*Primary Examiner*—Gary F. Paumen
*Attorney, Agent, or Firm*—Chilton, Alix & Van Kirk

[57] ABSTRACT

A universal ground clamp is employed for clamping to a ground electrode such as a conduit, a pipe or a rod by means of a clamp strap. The ground wire is secured by means of a set screw in an aperture of a head which extends from a threaded shank. A platen, which has a convex bowed surface, is retained against rotation by retainer flanges of a contact member. The platen is clamped against the strap to secure the ground clamp in position. The clamp may be mounted and the ground wire secured by applying a torque from one side of the ground clamp.

15 Claims, 1 Drawing Sheet

UNIVERSAL GROUND CLAMP

BACKGROUND OF THE INVENTION

This invention relates generally to electrical grounding devices. More particularly, the present invention relates to a universal grounding clamp which provides an electrical grounding connection with a pipe, a conduit or a ground electrode of various diameters.

A number of universal ground clamp devices have been advanced for providing an electrical ground connection with pipes, conduits and rods. Conventional devices provide a means wherein a solid or copper wire such as, for example, AWG wire sizes 6–12, are electrically connected to the pipe or conduit by a clamp device and are grounded to effect a grounding connection.

A number of conventional clamping devices are usable for a wide range of pipe or conduit diameters. The various clamping devices have a wide variety of configurations, and a number of conventional ground connector devices provide a sound mechanical and electrical connection to implement a grounding connection of high integrity.

U.S. Pat. No. 4,623,204 discloses a customer ready universal ground clamp which accommodates grounding electrodes and ground wires of various sizes and diameters. The clamp assembly includes a strap subassembly which is designed to provide a substantially full surface engagement with the electrode and an effective edge contact therewith. The clamp assembly includes a single bolt subassembly which employs a contoured fixed platen having a convex bowed surface to ensure intimate engagement between the straps of the subassembly and the grounding electrode. The engagement is implemented while at the same time avoiding any marring or gouging of the soft copper strap. The universal ground clamp employs a pair of nuts which are disposed at opposing axial positions of the bolt subassembly. The strap connects with a U-shaped contact clip. The strap has a plurality of apertures. The selected apertures pass through a portion of the bolt and are secured in position by tightening the nuts. A ground wire is positioned within a transverse wire receiving aperture of the bolt subassembly. A clamping cap includes a flange which clamps against the ground wire.

U.S. Pat. No. 4,626,051 discloses a universal ground clamp which also employs a clamping strap having a series of uniformly sized and spaced apertures to facilitate installation of the clamp onto a wide range of pipe, rod or conduit diameters. A brass stud, through which the clamping strap is secured, includes a terminal portion adapted to accommodate and have secured therein a terminated ground wire. A set screw is employed to secure the ground wire in position. A pair of convexly curved plates are supported on the stud and engage against the strap to provide a tight clamping action about the pipe, rod or conduit which is to be grounded. The curved plates are threaded to the bolt to clamp the strap to the conduit.

U.S. Pat. No. 4,784,621 discloses a wire connector for ground wires which employs a pair of jaw members. The jaw members are adapted to clamp to an I-beam. A head assembly includes a threaded shaft for securing the jaw members in clamped relationship. A bifurcated slot of the hex head receives one or more ground wires which are secured in fixed position by an axial set screw.

While the ground clamp devices, such as disclosed in U.S. Pat. No. 4,623,204, implement a sound electrical and mechanical connection for a ground conductor, there are applications wherein it is highly desirable that all of the torquing force which is applied to mount the device be applied from on side of the electrode engaging strap.

SUMMARY OF THE INVENTION

Briefly stated, the invention in a preferred form is a ground wire device which is adapted for connection with an electrode, such as a pipe, a service conduit or a rod for connecting a ground wire. The device comprises elongated straps which define a plurality of longitudinally spaced apertures. A contact member connecting with one end of the strap has a pair of laterally spaced upstanding flanges. The contact member also has an aperture which is alignable with apertures of the strap. A clip engages the contact member and forms a threaded socket which is alignable with apertures of the strap. A head subassembly includes an axially extended threaded shaft which is insertable through apertures of the strap and threadably couples with the socket. The head also includes a torque receiving portion, such as a hex head surface, and defines a transverse through-slot. A set screw is mounted to the head subassembly and threadably axially displaced relative to the slot for securing a ground wire in a position. A driver member, which has a convex bowed engagement surface is mounted to the shaft and is dimensioned for reception between the flanges of the contact member. Opposed ends of the driver are engageable with the flanges to limit angular rotation of the driver. The head may be threadably torqued for engagement against the retainer to clamp the strap around the electrode in an efficient and effective mechanical and electrical connection. The slot may have a bifurcated portion.

An object of the invention is to provide a new and improved universal ground clamp.

Another object of the invention is to provide a new and improved universal ground clamp which effectuates a ground connection between a ground wire and an electrode to implement an electrical and mechanical connection of high integrity.

A further object of the invention is to provide a new and improved universal ground clamp which efficiently implements a grounding connection between an electrode and a ground wire by applying a torque from one side of a strap which secures against the electrode.

Other objects and advantages of the invention will become apparent from the drawings and the specification.

DETAILED DESCRIPTION OF THE PREFERRED EMBODIMENT

With reference to the drawings wherein like numerals represent like parts throughout the several figures, a universal ground clamp, in accordance with the present invention, is designated generally by the numeral 10. In its preferred application and environment, the universal ground clamp encircles and electrically and mechanically engages a grounding electrode 12, such as a water pipe, a service conduit, a rod or a similar grounding member. The universal ground clamp 10 connects with the terminal end of a ground wire 16 for effecting a ground connection.

Figure 1:
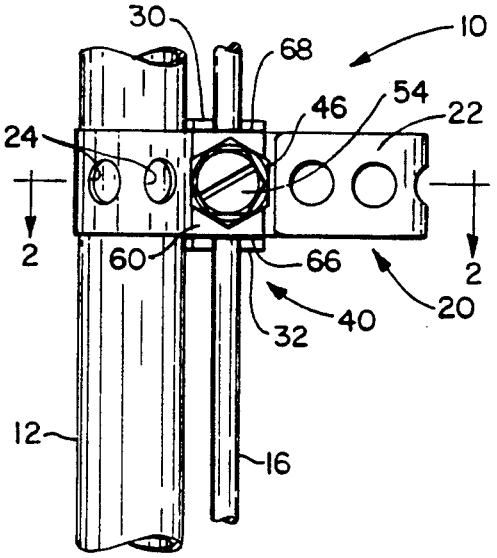
FIG. 1 is a top plan view of a universal ground clamp in accordance with the present invention, said ground clamp being secured to a ground electrode and connecting with a ground wire.
Figure 2:
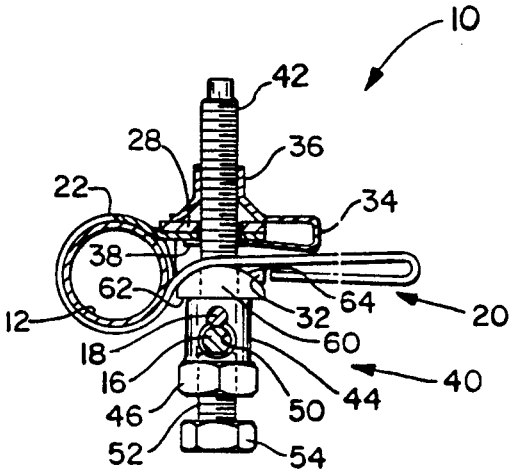
FIG. 2 is a cross-sectional view of the universal ground clamp, the ground wire and the ground electrode of FIG. 1, taken along the line 2—2 thereof.
Figure 3:
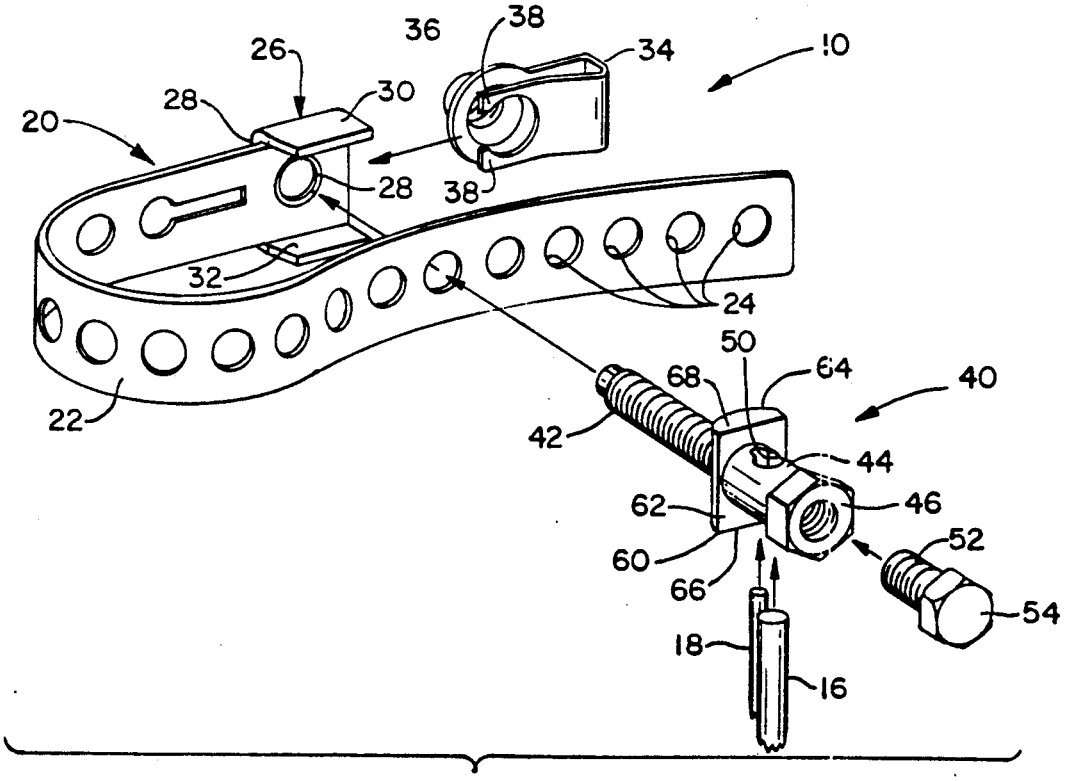
FIG. 3 is an exploded perspective view of the universal ground clamp of FIG. 1.

The universal ground clamp 10 essentially comprises a strap subassembly 20 and a bolt subassembly 40. The strap subassembly comprises an elongated ribbon-like flexible metal strap 22. The metal strap 22 is preferably formed of copper. The strap includes a plurality of circular apertures 24 which are spaced substantially the entire length of the strap. One end of the strap connects with a generally U-shaped, brass contact bracket 26 (FIG. 3). The contact bracket 26 includes a planar portion 28 having a central aperture. Aperture defining portions of the contact bracket are bent upwardly through an end aperture of the strap and crimped against the top portion of the strap to form an integral connecting lip 28. (The top, upper and lower adjectives used herein are based on the FIG. 1 top plan view orientation.) The bracket further includes a pair of upstanding retainer flanges 30 and 32. The flanges are substantially equidistantly spaced and the contact bracket 26 is dimensioned to be substantially commensurate with the transverse width of the strap 22.

A clip 34 is bent to form a generally U-shaped receiving slot. The clip 34 integrally connects with a socket 36 which is interiorly threaded. The clip has an upper pair of resilient fingers 38 which biasedly engage against the upper portion of the strap so that the socket 36 essentially aligns with the contiguous apertures and the contact bracket 26 and at least one spaced aperture 24 of the strap as will be detailed below. The socket ma be also connected to the contact bracket/strap assembly by other means including integrating the socket with the contact bracket.

The bolt subassembly 40 comprises a threaded shaft 42 which is insertable through a selected aperture 24 of the strap and the aperture of the contact plate 26 and into the socket 36. The shaft 42 axially extends from a boss 44, which in turn axially protrudes from a radially projecting hex head 46. The boss 44 includes a bifurcated slot 50 which extends transversely through the boss for receiving a ground wire 16 or a pair of ground wires 16,18. The slot is preferably dimensioned for receiving ground wires having a diameter range of AWG sizes 6–12. A set screw 52 having a hex head 54 axially threads into the boss 44 and hex head 46. The distal end of the set screw projects 52 into the slot 50 and engages the ground wire 16 to secure the ground wire or wires in fixed coupled relationship with the clamp.

A driver platen 60 has an enlarged opening so that the platen may be mounted to the shaft 42 for disposition between the boss and the upper surface of the strap. The driver platen 60 is generally slidable along the shaft. The platen has an upper surface 62 which generally has a planar rectangular shape and a bottom surface 64 which has a convex bowed elongated surface. The platen is dimensioned so that the opposing ends 66 and 68 are closely receivable between the retainer flanges. The platen surface 62 is engaged by the lower edge of the boss 44. A torque applied to the hex head surface threadably displaces the bolt shank axially to force the bowed surface 64 into surface-to-surface engagement against the upper surface of the strap 22 to thereby clamp the strap in position around the electrode 12. The platen 60 is dimensioned so that the ends 66 and 68 engage the retainer flanges 30 and 32 to limit angular rotation of the platen as the platen is tightened against the strap.

In a preferred installation, the strap is tightly wrapped around the grounding electrode 12 and a selected aperture 24 of the strap is brought into alignment with the aperture of the contact plate and the socket 36 to thereby form a strap loop. In practice, the excess strap may be reverse folded one or a number of times with one or more additional apertures being also positioned into a similar alignment. The flanges 30 and 32 function as strap guides. The shank of the bolt is inserted through the aligned strap apertures and the contact bracket aperture into the socket and threaded with the socket. The platen 60 is progressively clamped as the hex head surface is torqued so that the convex bowed elongated surface 64 of the platen is driven against the top of the strap to essentially reduce free play in the strap loop and tighten the strap against the grounding electrode. The ground wire 16 or wires 16,18 may be mounted by insertion into the wire receiving slot 50 and suitably torquing the set screw 52 to secure the wire or wires in position.

It should be appreciated that the foregoing universal ground clamp provides an efficient means for clamping against the grounding electrode in a mechanical connection which does not marr the copper strap even though the strap is subjected to a high torque. Moreover, the torque required to mount and secure the clamp in position as well as to secure the ground wires is applied from one side of the strap (the top end in the illustrated FIG. 1 embodiment), and thus the universal ground clamp is particularly advantageous in applications wherein the room constraints do not easily permit application of torque from both sides of the strap.

While a preferred embodiment of the foregoing invention has been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. A ground wire connector adapted for mounting to a conduit for connecting a ground wire comprising:

an elongated strap defining a plurality of longitudinally spaced apertures;

a guide member having a pair of laterally spaced flanges and defining an aperture aligned with a said strap aperture;

clip means comprising a clip engageable against said strap and a coupling member defining a threaded socket, said strap apertures being alignable with said socket;

bolt means comprising an axially extending threaded shaft threadably couplable with said socket, said bolt means comprising a torque receiving portion and a head defining a transverse opening;

a set screw mounted to said bolt means and axially thradably displaceable relative to said opening; and a driver member mounted to said shaft and having a convex engagement surface, said member being dimensioned for reception between said flanges, so that said shaft may be inserted through a first and a second said strap aperture and threaded to said socket, and a torque applied to said torque receiving portion clamps said driver member against said strap.

2. The ground wire connector of claim 1 wherein said driver member has a pair of opposed ends, said ends being engageable against said flanges to limit angular rotation of said driver member.

3. The ground wire connector of claim 1 wherein said guide member is crimped to said strap.

4. The ground wire connector of claim 1 wherein said clip defines a quasi-U-shaped slot which receives a portion of said strap and said guide member.

5. A ground wire connector adapted for mounting to a conduit for connecting a ground wire comprising:

an elongated strap defining a plurality of longitudinally spaced apertures;

a guide member connected to said strap and having a pair of laterally spaced flanges, said member having a planar portion defining an aperture;

coupling means comprising a coupling member defining a threaded socket aligned with said guide member aperture;

bolt means comprising an axially extending threaded shaft threadably couplable with said socket, said bolt means comprising a torque receiving portion and a head defining a transverse opening;

wire securement means mounted to said bolt means for securing a ground wire in said transverse opening; and a driver member mounted to said shaft and having a convex engagement surface, said member being dimensioned for reception between said flanges and axially engageable by said bolt means, so that said shaft may be inserted through a said strap aperture and the guide member aperture and threaded to said socket, and a torque applied to said torque receiving portion axially clamps said driver member convex engagement surface against said strap.

6. The ground wire connector of claim 5 wherein said driver member has a pair of opposed ends, said ends being engageable against said flanges to limit angular rotation of said driver member.

7. The ground wire connector of claim 5 wherein said guide member is crimped to said strap.

8. The ground wire connector of claim 5 wherein said strap is positioned between said driver member and said socket means.

9. A ground wire connector adapted for mounting to a conduit for connecting a ground wire comprising:

an elongated strap defining a plurality of longitudinally spaced apertures;

a guide member having a pair of laterally spaced flanges and a planar portion defining an aperture aligned with a said strap aperture;

coupling means comprising a coupling member defining a threaded socket aligned with said guide member aperture;

bolt means comprising a head and an axially extending threaded shaft threadably couplable with said socket, said bolt means comprising a torque receiving portion;

wire securement means mounted to said bolt means for securing a ground wire to said head; and a driver member mounted to said shaft, said driver member having a pair of opposed ends engageable against said flanges, so that said strap forms a loop and said shaft may be inserted through a first and a second said strap aperture and threaded to said socket, and a torque applied to said torque receiving portion axially clamps said driver member against said strap to tighten said loop.

10. The ground wire connector of claim 9 wherein said driver member ends are engageable against said flanges to limit angular rotation of said driver member.

11. The ground wire connector of claim 9 wherein said guide member is crimped to said strap.

12. The ground wire connector of claim 9 wherein said coupling means further comprises a clip and said clip defines a quasi U-shaped slot which receives a portion of said strap and said guide member.

13. The ground wire connector of claim 9 wherein said driver member has a convex engagement surface.

14. The ground wire connector of claim 9 wherein said guide member is crimped to said strap through a strap aperture.

15. The ground wire connector of claim 12 wherein said clip is biased into engagement against said strap and said guide member.

* * * * *